US009858946B2

(12) United States Patent
Sugiyama et al.

(10) Patent No.: US 9,858,946 B2
(45) Date of Patent: Jan. 2, 2018

(54) SIGNAL PROCESSING APPARATUS, SIGNAL PROCESSING METHOD, AND SIGNAL PROCESSING PROGRAM

(71) Applicants: NEC Corporation, Tokyo (JP); Renesas Electronics Corporation, Tokyo (JP)

(72) Inventors: Akihiko Sugiyama, Tokyo (JP); Kwangsoo Park, Tokyo (JP); Ryoji Miyahara, Tokyo (JP)

(73) Assignees: NEC Corporation, Tokyo (JP); Renesas Electronics Corporation, Tokyo (JP)

( * ) Notice: Subject to any disclaimer, the term of this patent is extended or adjusted under 35 U.S.C. 154(b) by 0 days.

(21) Appl. No.: 14/773,271

(22) PCT Filed: Feb. 26, 2014

(86) PCT No.: PCT/JP2014/054633
§ 371 (c)(1),
(2) Date: Sep. 4, 2015

(87) PCT Pub. No.: WO2014/136628
PCT Pub. Date: Sep. 12, 2014

(65) Prior Publication Data

US 2016/0019913 A1 Jan. 21, 2016

(30) Foreign Application Priority Data

Mar. 5, 2013 (JP) ..... 2013-042447

(51) Int. Cl.
*G10L 25/51* (2013.01)
*G10L 21/0232* (2013.01)
(Continued)

(52) U.S. Cl.
CPC ..... *G10L 25/51* (2013.01); *G10L 21/0232* (2013.01); *G10L 21/0264* (2013.01); *G10L 25/18* (2013.01); *G10L 25/87* (2013.01)

(58) Field of Classification Search
CPC . G10L 25/51; G10L 21/0232; G10L 21/0264; G10L 25/18; G10L 25/87
See application file for complete search history.

(56) References Cited

U.S. PATENT DOCUMENTS 8,073,147 B2 * 12/2011 Sugiyama ..... H04B 3/23 370/286
2005/0114128 A1 5/2005 Hetherington et al.
(Continued)

FOREIGN PATENT DOCUMENTS

CA 2529594 6/2006
EP 1669983 A1 6/2006
(Continued)

OTHER PUBLICATIONS

International Search Reporting corresponding to PCT/JP2014/054633, dated Apr. 22, 2014, (5 pages).
(Continued)

*Primary Examiner* — Brenda Bernardi
(74) *Attorney, Agent, or Firm* — Wilmer Cutler Pickering Hale and Dorr LLP

(57) ABSTRACT

Disclosed is a signal processing apparatus that processes an input signal to accurately detect an abrupt change in the input signal in accordance with the degree of linear change of a phase component in a frequency domain. The signal processing apparatus includes a converter that converts the input signal into the phase component and an amplitude component in the frequency domain, a linearity calculator that calculates the linearity of the phase component in the frequency domain, and a determiner that determines pres-
(Continued)

ence of the abrupt change in the input signal based on the linearity calculated by the linearity calculator.

7 Claims, 15 Drawing Sheets

(51) Int. Cl.
*G10L 25/87* (2013.01)
*G10L 21/0264* (2013.01)
*G10L 25/18* (2013.01)

(56) References Cited

U.S. PATENT DOCUMENTS

| | | | | |
|---|---|---|---|---|
| 2005/0199064 | A1* | 9/2005 | Wen | G01H 1/00 73/584 |
| 2011/0112670 | A1* | 5/2011 | Disch | G10L 21/04 700/94 |
| 2013/0003992 | A1 | 1/2013 | Disch et al. | |

FOREIGN PATENT DOCUMENTS

| | | |
|---|---|---|
| JP | 05-073093 | 3/1993 |
| JP | 2006-163417 | 6/2006 |
| JP | 2007-251908 | 9/2007 |
| JP | 2010-237703 | 10/2010 |
| JP | 2011-0514987 | 5/2011 |
| JP | 2011-199808 | 10/2011 |
| JP | 2011-254122 | 12/2011 |
| WO | WO-2008/111462 | 9/2008 |
| WO | WO-2009/112141 | 9/2009 |

OTHER PUBLICATIONS

M. Kato, A. Sugiyama, and M. Serizawa, "Noise suppression with high speech quality based on weighted noise estimation and MMSE STSA", IEICE Trans. Fundamentals (Japanese Edition), vol. J87-A, No. 7, pp. 851-860, Jul. 2004, (12 pages).

R. Martin, "Spectral subtraction based on minimum statistics", EUSPICO-94, pp. 1182-1185, Sep. 1994, (7 pages).

J.L. Flanagan et al., "Speech Coding", IEEE Transactions on Communications, vol. 27, No. 4, Apr. 1979, (28 pages).

JIS, "1.5-Mbit/s encoding of video signal and additional audio signal for digital storage media—section 3, audio," JIS X 4323, p. 99, 2 pages (Nov. 1996).

* cited by examiner

SIGNAL PROCESSING APPARATUS, SIGNAL PROCESSING METHOD, AND SIGNAL PROCESSING PROGRAM

CROSS-REFERENCE TO RELATED APPLICATIONS

This application is a national stage application of International Application No. PCT/JP2014/054633 entitled "SIGNAL PROCESSING APPARATUS, SIGNAL PROCESSING METHOD, AND SIGNAL PROCESSING PROGRAM," filed on Feb. 26, 2014, which claims the benefit of the priority of Japanese Patent Application No. 2013-042447, filed on Mar. 5, 2013, the disclosures of each of which are hereby incorporated by reference in their entirety.

TECHNICAL FIELD

The present invention relates to a technique of detecting a change in a signal.

BACKGROUND ART

In the above technical field, patent literature 1 discloses a technique of evaluating the continuity of a phase component in the time direction and smoothing an amplitude component for each frequency (paragraphs 0135 to 0138). Patent literature 2 describes detecting an abrupt frequency change by measuring a fluctuation in a phase in the time direction. Patent literature 3 describes, in paragraph 0024, that "a phase change in the complex vector of I and Q signals on a complex plane caused by superimposition of impulsive noise is always monitored, thereby reliably detecting the impulsive noise under a strong field environment". The phase change is a change in the time direction. Patent literature 4 describes, in paragraph 0031, that "a phase linearizer 25 corrects a hop in a phase signal θ input from a polar coordinate converter 24 by linearization and outputs a resultant phase signal θ' to a phase detector 26". In addition, patent literature 4 has a description of a phase gradient detector in paragraph 0051, and also describes, in paragraph 0040, that "FIG. 5 shows an example of the input and output signals (a phase θ' that is an input signal and a phase gradient dθ' that is an output signal) of the phase detector 26". Patent literature 5 discloses a technique of detecting an impulsive sound using an amplitude.

CITATION LIST

Patent Literature

Patent literature 1: Japanese Patent Laid-Open No. 2010-237703

Patent literature 2: Japanese Patent Laid-Open No. 2011-254122

Patent literature 3: Japanese Patent Laid-Open No. 2007-251908

Patent literature 4: Japanese Patent Laid-Open No. 2011-199808

Patent literature 5: WO 2008/111462

Non-Patent Literature

Non-patent literature 1: M. Kato, A. Sugiyama, and M. Serizawa, "Noise suppression with high speech quality based on weighted noise estimation and MMSE STSA", IEICE Trans. Fundamentals (Japanese Edition), vol. J87-A, no. 7, pp. 851-860, July 2004.

Non-patent literature 2: R. Martin, "Spectral subtraction based on minimum statistics", EUSPICO-94, pp. 1182-1185, September 1994.

Non-patent literature 3: J. L. Flanagan et al., "Speech Coding", IEEE Transactions on Communications, Vol. 27, no. 4, April 1979.

Non-patent literature 4: "1.5-Mbit/s encoding of video signal and additional audio signal for digital storage media—section 3, audio", JIS X 4323, p. 99, November 1996.

SUMMARY OF THE INVENTION

Technical Problem

However, the techniques of patent literatures 1 and 4 out of the above-described related arts do not detect an abrupt change in an input signal. In addition, the technique of patent literature 2 detects an abrupt change in a "frequency", and the technique of patent literature 3 detects impulsive noise using a time-rate change in the phase of an AM signal. Patent literature 5 discloses a technique of detecting an impulsive sound using only an amplitude, which is poor in robustness. That is, the techniques described in these literatures cannot effectively detect an abrupt change in a signal.

The present invention enables to provide a technique of solving the above-described problems.

Solution to Problem

One aspect of the present invention provides a signal processing apparatus comprising:

a converter that converts an input signal into a phase component and an amplitude component in a frequency domain;

a linearity calculator that calculates a linearity of the phase component in the frequency domain; and a determiner that determines presence of an abrupt change in the input signal based on the linearity calculated by the linearity calculator.

Another aspect of the present invention provides a signal processing method comprising:

converting an input signal into a phase component and an amplitude component in a frequency domain;

calculating a linearity of the phase component in the frequency domain; and determining presence of an abrupt change in the input signal based on the calculated linearity.

Still other aspect of the present invention provides a signal processing program for causing a computer to execute a method comprising:

converting an input signal into a phase component and an amplitude component in a frequency domain;

calculating a linearity of the phase component in the frequency domain; and determining presence of an abrupt change in the input signal based on the calculated linearity.

Advantageous Effects of Invention

According to the present invention, it is possible to effectively detect an abrupt change in a signal.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise. Note that "speech signal" in the following explanation indicates a direct electrical change that occurs in accordance with the influence of speech or another sound. The speech signal transmits speech or another sound and is not limited to speech.

First Embodiment

A signal processing apparatus 100 according to the first embodiment of the present invention will be described with reference to FIG. 1. The signal processing apparatus 100 is an apparatus for detecting an abrupt input signal change.

Figure 1:
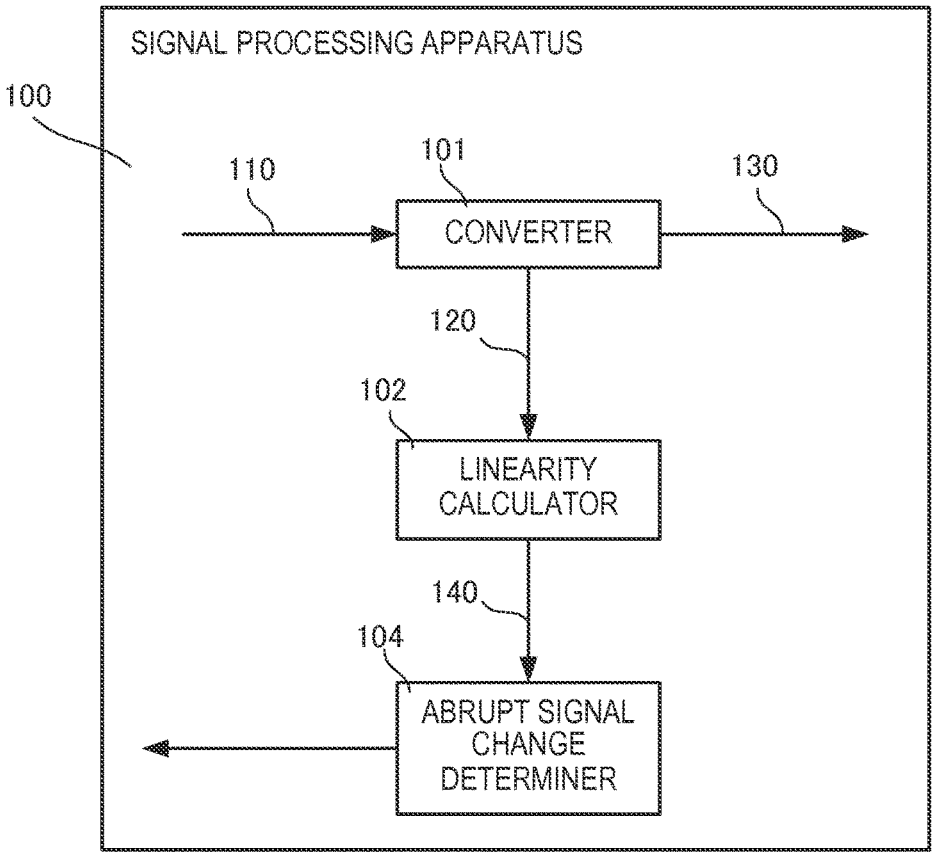
FIG. 1 is a block diagram showing the arrangement of a signal processing apparatus according to the first embodiment of the present invention.

As shown in FIG. 1, the signal processing apparatus 100 includes a converter 101, a linearity calculator 102, and an abrupt signal change determiner 104. The converter 101 converts an input signal 110 into a phase component 120 and an amplitude component 130 in a frequency domain. The linearity calculator 102 calculates a linearity 140 of the phase component 120. The abrupt signal change determiner 104 determines the presence of an abrupt change in the input signal based on the linearity 140 calculated by the linearity calculator 102.

With the above-described arrangement, an abrupt change in the input signal can accurately be detected based on the degree of the linear change in the phase component in the frequency domain.

Second Embodiment

<<Overall Arrangement>>

A noise suppression apparatus according to the second embodiment of the present invention will be described with reference to FIGS. 2 to 11. The noise suppression apparatus according to this embodiment is applicable to suppress noise in, for example, a digital camera, a notebook personal computer, a mobile phone, a keyboard, a game machine controller, and the push buttons of a mobile phone. That is, the target signal of speech, music, environmental sound, or the like can be enhanced relative to a signal (noise or interfering signal) superimposed on it. However, the present invention is not limited to this, and the noise suppression apparatus is applicable to a signal processing apparatus of any type required to do abrupt signal change determination from an input signal. Note that in this embodiment, a noise suppression apparatus that detects and suppresses an impulsive sound as an example of an abrupt change in a signal will be described. The noise suppression apparatus according to this embodiment appropriately removes an impulsive sound generated by, for example, a button operation in a mode to perform an operation such as button pressing near a microphone. Simply speaking, a signal including an impulsive sound is converted into a frequency domain signal, and the linearity of a phase component with respect to the frequency space is calculated. If there are many frequencies having a high linearity (having a predetermined gradient), it is determined that an impulsive sound is detected.

Figure 2:
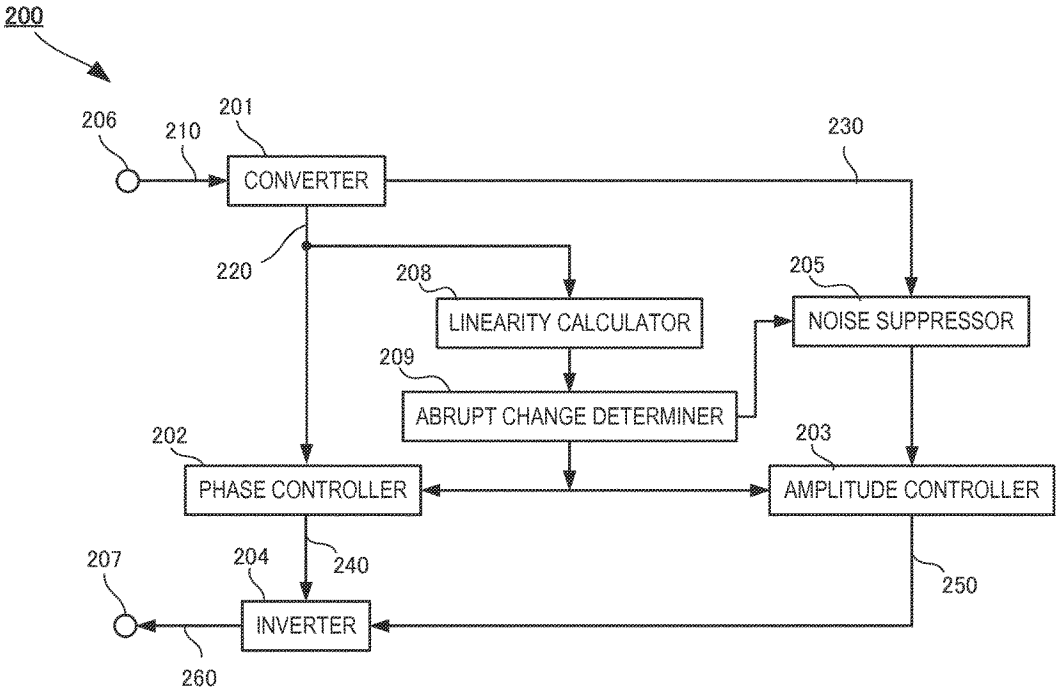
FIG. 2 is a block diagram showing the arrangement of a noise suppression apparatus according to the second embodiment of the present invention.

FIG. 2 is a block diagram showing the overall arrangement of a noise suppression apparatus 200. A noisy signal (signal including both a desired signal and noise) is supplied to an input terminal 206 as a series of sample values. The noisy signal supplied to the input terminal 206 undergoes transform such as Fourier transform in a converter 201 and is divided into a plurality of frequency components. The plurality of frequency components are independently processed on a frequency basis. The description will be continued here concerning a specific frequency component of interest. Out of the frequency component, an amplitude spectrum (amplitude component) 230 is supplied to a noise suppressor 205, and a phase spectrum (phase component) 220 is supplied to a phase controller 202 and a linearity calculator 208. Note that the converter 201 supplies the noisy signal amplitude spectrum 230 to the noise suppressor 205 here. However, the present invention is not limited to this, and a power spectrum corresponding to the square of the amplitude spectrum may be supplied to the noise suppressor 205.

The noise suppressor 205 estimates noise using the noisy signal amplitude spectrum 230 supplied from the converter 201, thereby generating an estimated noise spectrum. In addition, the noise suppressor 205 suppresses the noise using the generated estimated noise spectrum and the noisy signal amplitude spectrum 230 supplied from the converter 201, and transmits an enhanced signal amplitude spectrum as a noise suppression result to an amplitude controller 203. The noise suppressor 205 also receives a determination result from an abrupt change determiner 209, and executes noise suppression in accordance with the presence/absence of an abrupt change in the signal.

The phase controller 202 rotates (shifts) the noisy signal phase spectrum 220 supplied from the converter 201, and supplies it to an inverter 204 as an enhanced signal phase spectrum 240. The phase controller 202 also transmits the phase rotation amount (shift amount) to the amplitude controller 203. The amplitude controller 203 receives the phase rotation amount (shift amount) from the phase controller 202, calculates an amplitude correction amount, corrects the enhanced signal amplitude spectrum in each frequency using the amplitude correction amount, and supplies a corrected amplitude spectrum 250 to the inverter 204. The inverter 204 performs inversion by compositing the enhanced signal phase spectrum 240 supplied from the phase controller 202 and the corrected amplitude spectrum supplied from the amplitude controller 203, and supplies the resultant signal to an output terminal 207 as an enhanced signal.

The linearity calculator 208 calculates the linearity in the frequency domain using the phase spectrum 220 supplied from the converter 201. The abrupt change determiner 209 determines the presence/absence of an abrupt signal change based on the linearity calculated by the linearity calculator 208.

<<Arrangement of Converter>>

Figure 3:
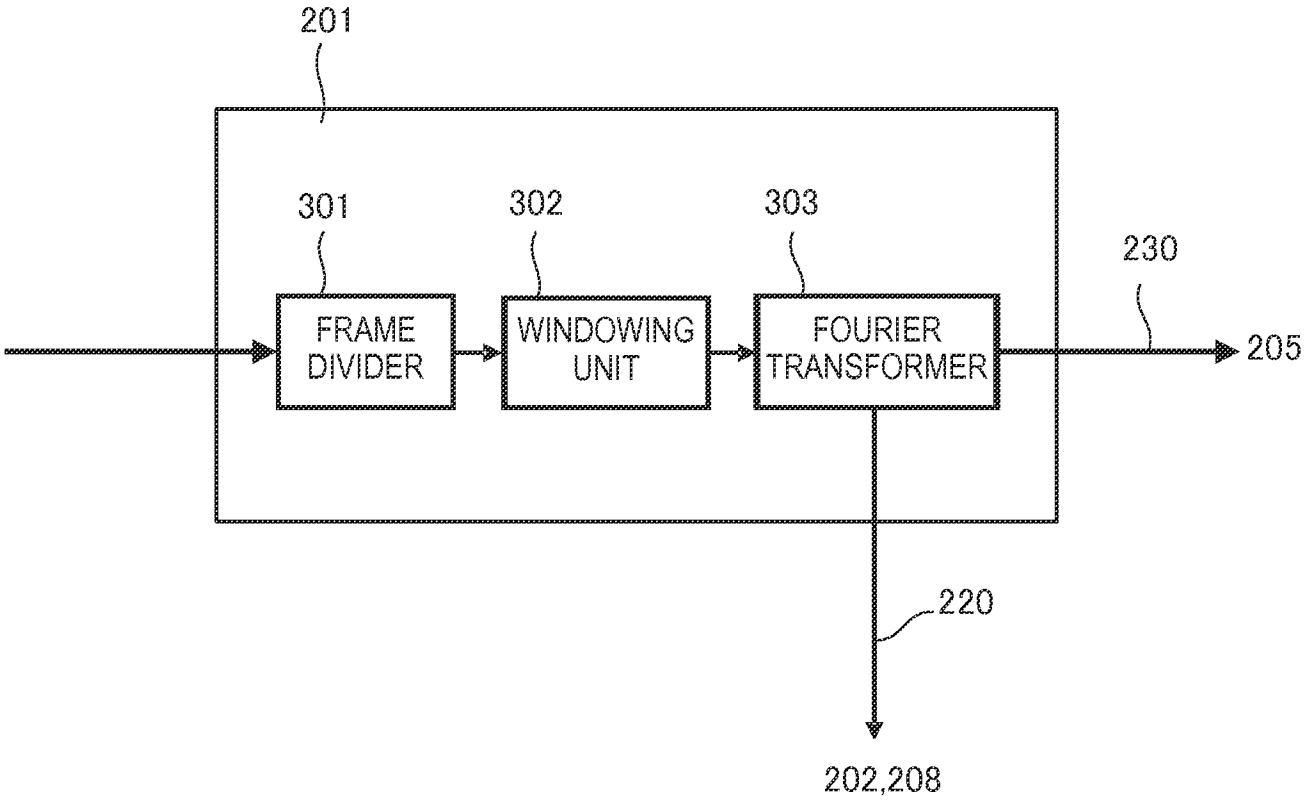
FIG. 3 is a block diagram showing the arrangement of a converter according to the second embodiment of the present invention.

FIG. 3 is a block diagram showing the arrangement of the converter 201. As shown in FIG. 3, the converter 201 includes a frame divider 301, a windowing unit 302, and a Fourier transformer 303. A noisy signal sample is supplied to the frame divider 301 and divided into frames on the basis of K/2 samples, where K is an even number. The noisy signal sample divided into frames is supplied to the windowing unit 302 and multiplied by a window function w(t). The signal obtained by windowing an nth frame input signal $y_n(t)$ (t=0, 1, . . . , K/2−1) by w(t) is given by $$\bar{y}_n(t)=w(t))y_n(t) \tag{1}$$

Two successive frames may partially be overlaid (overlapped) and windowed. Assume that the overlap length is 50% the frame length. For t=0, 1, . . . , K/2−1, the windowing unit 302 outputs the left-hand sides of $$\left.\begin{aligned}\bar{y}_n = (t) = w(t)y_{n-1}(t+K/2)\\ \bar{y}_n(t+K/2) = w(t+K/2)y_n(t)\end{aligned}\right\} \tag{2}$$

A symmetric window function is used for a real signal. The window function is designed to make the input signal and the output signal match with each other except a calculation error when the output of the converter 201 is directly supplied to the inverter 204. This means w(t)+w(t+K/2)=1.

The description will be continued below assuming an example in which windowing is performed for two successive frames that overlap 50%. As w(t), the windowing unit can use, for example, a Hanning window given by $$w(t) = \begin{cases} 0.5 + 0.5\cos\left(\dfrac{\pi(t-K/2)}{K/2}\right), & 0 \le t \le K \\ 0, & \text{otherwise} \end{cases} \tag{3}$$

Various window functions such as a Hamming window and a triangle window are also known. The windowed output is supplied to the Fourier transformer 303 and transformed into a noisy signal spectrum $Y_n(k)$. The noisy signal spectrum $Y_n(k)$ is separated into the phase and the amplitude. A noisy signal phase spectrum arg $Y_n(k)$ is supplied to the phase controller 202 and the linearity calculator 208, whereas a noisy signal amplitude spectrum $|Y_n(k)|$ is supplied to the noise suppressor 205. As already described, a power spectrum may be used in place of the amplitude spectrum.

<<Arrangement of Inverter>>

Figure 4:
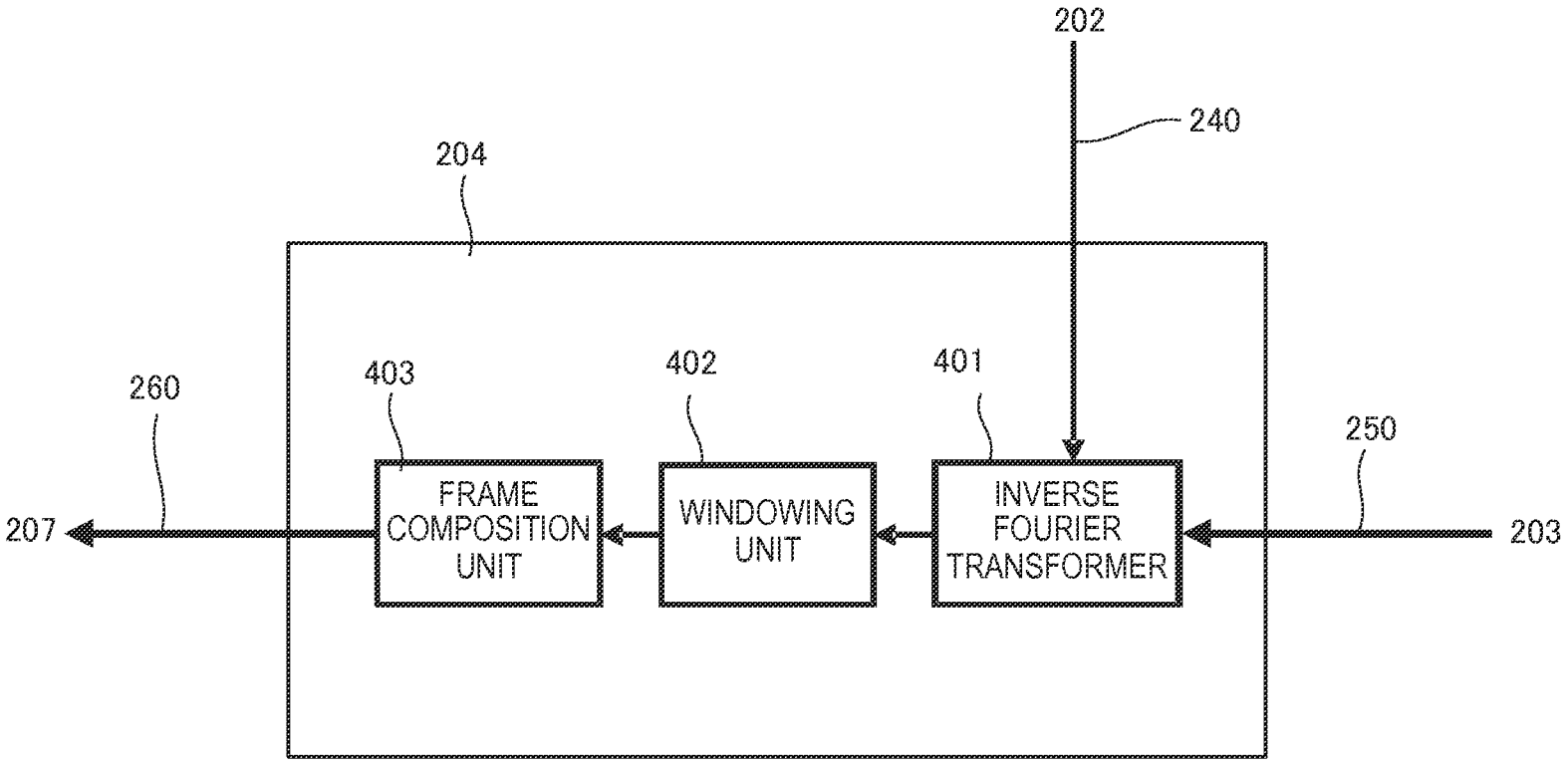
FIG. 4 is a block diagram showing the arrangement of an inverter according to the second embodiment of the present invention.

FIG. 4 is a block diagram showing the arrangement of the inverter 204. As shown in FIG. 4, the inverter 204 includes an inverse Fourier transformer 401, a windowing unit 402, and a frame composition unit 403. The inverse Fourier transformer 401 multiplies the enhanced signal amplitude spectrum 250 supplied from the amplitude controller 203 by the enhanced signal phase spectrum 240 arg $X_n(k)$ supplied from the phase controller 202 to obtain an enhanced signal (the left-hand side of equation (4))

$$\bar{X}_n(k)=|\bar{X}_n(k)|\cdot\arg X_n(k) \tag{4}$$

Inverse Fourier transform is performed for the obtained enhanced signal. The signal is supplied to the windowing unit 402 as a series of time domain sample values $x_n(t)$ (t=0, 1, . . . , K−1) in which one frame includes K samples, and multiplied by the window function w(t). A signal obtained by windowing an nth frame input signal $x_n(t)$ (t=0, 1, . . . , K/2−1) by w(t) is given by the left-hand side of $$\bar{x}_n(t)=w(t)x_n(t) \tag{5}$$

Two successive frames may partially be overlaid (overlapped) and windowed. Assume that the overlap length is 50% the frame length. For t=0, 1, . . . , K/2−1, the windowing unit 402 outputs the left-hand sides of $$\left.\begin{aligned}\bar{x}_n(t) = w(t)x_{n-1}(t+K/2)\\ \bar{x}_n(t+K/2) = w(t+K/2)x_n(t)\end{aligned}\right\} \tag{6}$$

and transmits them to the frame composition unit 403.

The frame composition unit 403 extracts the outputs of two adjacent frames from the windowing unit 402 on the basis of K/2 samples, overlays them, and obtains an output signal (left-hand sides of equation (7)) for t=0, 1, . . . , K−1 by $$\hat{x}_n(t)=\bar{x}_{n-1}(t+K/2)+\bar{x}_n(t) \tag{7}$$

An obtained enhanced signal 260 is transmitted from the frame composition unit 403 to the output terminal 207.

Note that the conversion in the converter and the inverter in FIGS. 3 and 4 has been described as Fourier transform. However, any other transform such as Hadamard transform, Haar transform, or Wavelet transform may be used in place of the Fourier transform. Haar transform does not need multiplication and can reduce the area of an LSI chip. Wavelet transform can change the time resolution depending on the frequency and is therefore expected to improve the noise suppression effect.

The noise suppressor 205 may perform actual suppression after a plurality of frequency components obtained by the converter 201 are integrated. At this time, high sound quality can be achieved by integrating more frequency components from the low frequency range where the discrimination capability of hearing characteristics is high to the high frequency range with a poorer capability. When noise suppression is executed after integrating a plurality of frequency components, the number of frequency components to which noise suppression is applied decreases, and the whole calculation amount can be decreased.

<<Arrangement of Noise Suppressor>>

The noise suppressor 205 estimates noise using the noisy signal amplitude spectrum supplied from the converter 201 and generate an estimated noise spectrum. The noise suppressor 205 then obtains a suppression coefficient using the noisy signal amplitude spectrum from the converter 201 and the generated estimated noise spectrum, multiplies the noisy signal amplitude spectrum by the suppression coefficient, and supplies the resultant spectrum to the amplitude controller 203 as an enhanced signal amplitude spectrum. Upon receiving an abrupt change determination result (information representing whether an abrupt change in the signal exists) from the abrupt change determiner 209 and determining that an abrupt change has occurred, the noise suppressor 205 supplies a smaller one of the noisy signal amplitude spectrum and the estimated noise spectrum to the amplitude controller 203 as an enhanced signal amplitude spectrum.

To estimate noise, various estimation methods are used, as described in non-patent literature 2.

For example, non-patent literature 1 discloses a method of obtaining, as an estimated noise spectrum, the average value of noisy signal amplitude spectra of frames in which no target sound is generated. In this method, it is necessary to detect generation of the target sound. A section where the target sound is generated can be determined by the power of the enhanced signal.

As an ideal operation state, the enhanced signal is the target sound other than noise. In addition, the level of the target sound or noise does not largely change between adjacent frames. For these reasons, the enhanced signal level of an immediately preceding frame is used as an index to determine a noise section. If the enhanced signal level of the immediately preceding frame is equal to or smaller than a predetermined value, the current frame is determined as a noise section. A noise spectrum can be estimated by averaging the noisy signal amplitude spectra of frames determined as a noise section.

Non-patent literature 1 also discloses a method of obtaining, as an estimated noise spectrum, the average value of noisy signal amplitude spectra in the early stage in which supply of them has started. In this case, it is necessary to meet a condition that the target sound is not included immediately after the start of estimation. If the condition is met, the noisy signal amplitude spectrum in the early stage of estimation can be obtained as the estimated noise spectrum.

Non-patent literature 2 discloses a method of obtaining an estimated noise spectrum from the minimum value of the statistical noisy signal amplitude spectrum. In this method, the minimum value of the noisy signal amplitude spectrum within a predetermined time is statistically held, and a noise spectrum is estimated from the minimum value. The minimum value of the noisy signal amplitude spectrum is similar to the shape of a noise spectrum and can therefore be used as the estimated value of the noise spectrum shape. However, the minimum value is smaller than the original noise level. Hence, a spectrum obtained by appropriately amplifying the minimum value is used as an estimated noise spectrum.

The noise suppressor 205 can perform various kinds of suppression. Typical examples are the SS (Spectrum Subtraction) method and an MMSE STSA (Minimum Mean-Square Error Short-Time Spectral Amplitude Estimator) method. In the SS method, the estimated noise spectrum is subtracted from the noisy signal amplitude spectrum supplied from the converter 201. In the MMSE STSA method, a suppression coefficient is calculated using the noisy signal amplitude spectrum supplied from the converter 201 and the generated estimated noise spectrum, and the noisy signal amplitude spectrum is multiplied by the suppression coefficient. The suppression coefficient is decided so as to minimize the mean square power of the enhanced signal.

<<Arrangement of Phase Controller and Amplitude Controller>>

Figure 5:
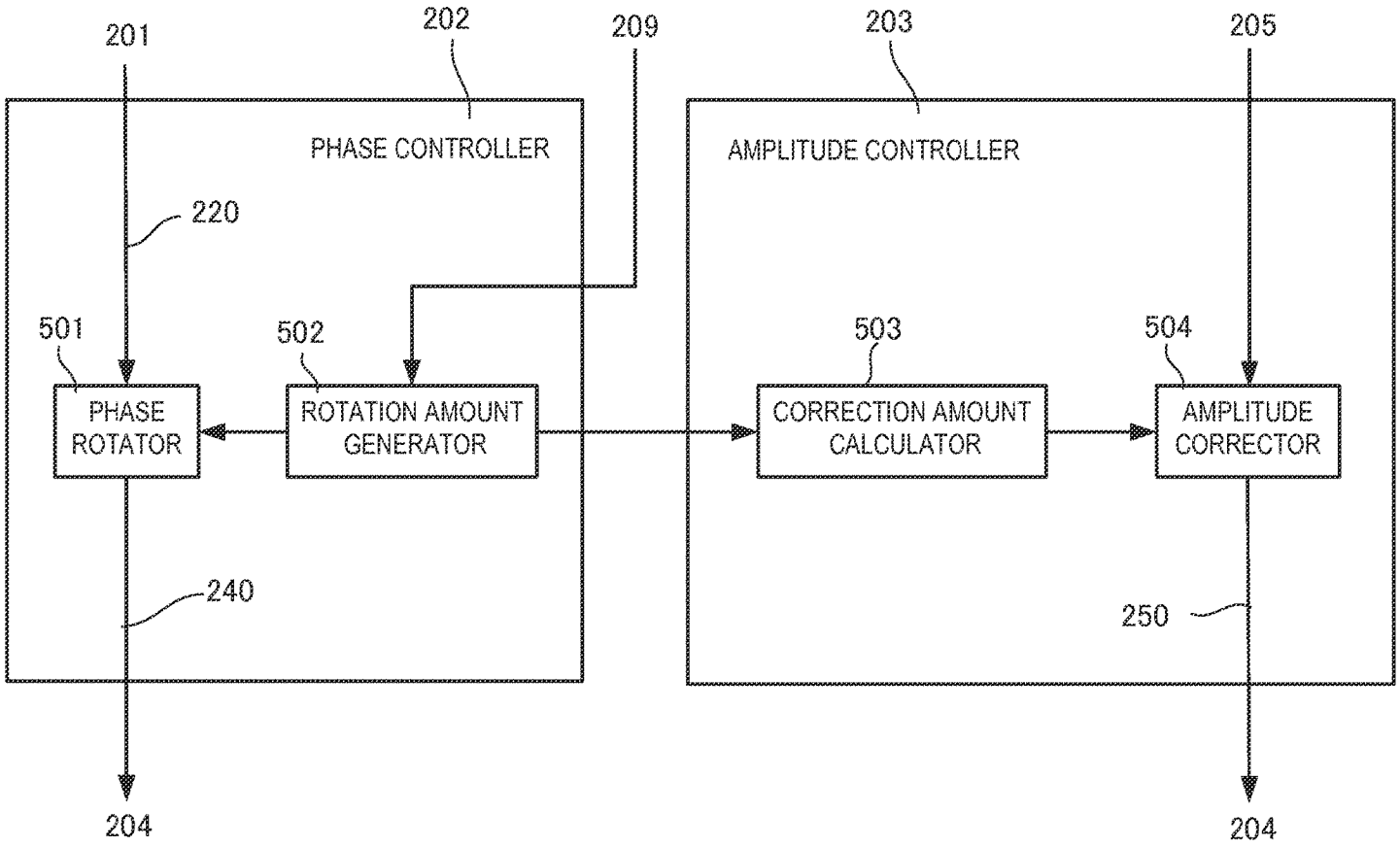
FIG. 5 is a block diagram showing the arrangement of a phase controller and an amplitude controller according to the second embodiment of the present invention.

FIG. 5 is a block diagram showing the arrangement of the phase controller 202 and the amplitude controller 203. As shown in FIG. 5, the phase controller 202 includes a phase rotator 501 and a rotation amount generator 502, and the amplitude controller 203 includes a correction amount calculator 503 and an amplitude corrector 504.

The rotation amount generator 502 generates the rotation amount of the noisy signal phase spectrum for a frequency component determined to "have an abrupt change in the signal" by the abrupt change determiner 209, and supplies the rotation amount to the phase rotator 501 and the correction amount calculator 503. Upon receiving the rotation amount supplied from the rotation amount generator 502, the phase rotator 501 rotates (shifts) the noisy signal phase spectrum 220 supplied from the converter 201 by the supplied rotation amount, and supplies the rotated spectrum to the inverter 204 as the enhanced signal phase spectrum 240.

The correction amount calculator 503 decides the correction coefficient of the amplitude based on the rotation amount supplied from the rotation amount generator 502, and supplies the correction coefficient to the amplitude corrector 504.

The rotation amount generator 502 generates the rotation amount by, for example, a random number. When the noisy signal phase spectrum is rotated for each frequency by a random number, the shape of the noisy signal phase spectrum 220 changes. With the change in the shape, the feature of noise such as an impulsive sound can be weakened.

Examples of the random number are a uniform random number whose occurrence probability is uniform and a normal random number whose occurrence probability exhibits a normal distribution. A rotation amount generation method using a uniform random number will be described first. A uniform random number can be generated by a linear congruential method or the like. For example, uniform random numbers generated by the linear congruential method are uniformly distributed within the range of 0 to (2^M)−1, where M is an arbitrary integer, and ^ represents a power. Phase rotation amounts φ need to be distributed within the range of 0 to 2π. To do this, the generated uniform random numbers are converted. The conversion is performed by $$\phi = 2\pi \frac{R}{R_{max}} \tag{8}$$

where R is the uniform random number, and Rmax is the maximum value capable of being generated by the uniform random number. When a uniform random number is generated by the above-described linear congruential method, Rmax=(2^M)−1.

To simplify the calculation, the value R may directly be decided as the rotation amount. As the rotation amount, $2\pi$ represents just one revolution. A case where the phase is rotated by $2\pi$ is equivalent to a case where the phase is not rotated. Hence, a rotation amount $2\pi+\alpha$ is equivalent to a rotation amount $\alpha$. A case where a uniform random number is generated by the linear congruential method has been explained here. Even in a case where a uniform random number is generated by another method, the rotation amount $\varphi$ is obtained by equation (8). When and how many times random number generation is to be performed may be decided in accordance with the determination result of the abrupt change determiner 209.

The phase rotator 501 receives the rotation amount from the rotation amount generator 502 and rotates the noisy signal phase spectrum. If the noisy signal phase spectrum is expressed as an angle, it can be rotated by adding the value of the rotation amount $\varphi$ to the angle. If the noisy signal phase spectrum is expressed as the normal vector of a complex number, it can be rotated by obtaining the normal vector of the rotation amount $\varphi$ and multiplying the noisy signal phase spectrum by the normal vector.

The normal vector of the rotation amount $\varphi$ can be obtained by $$\Phi=\cos(\varphi)+j\sin(\varphi) \tag{9}$$

In equation (9), $\Phi$ is the rotation vector, and j represents sqrt(−1). Note that sqrt is the square root.

Figure 6:
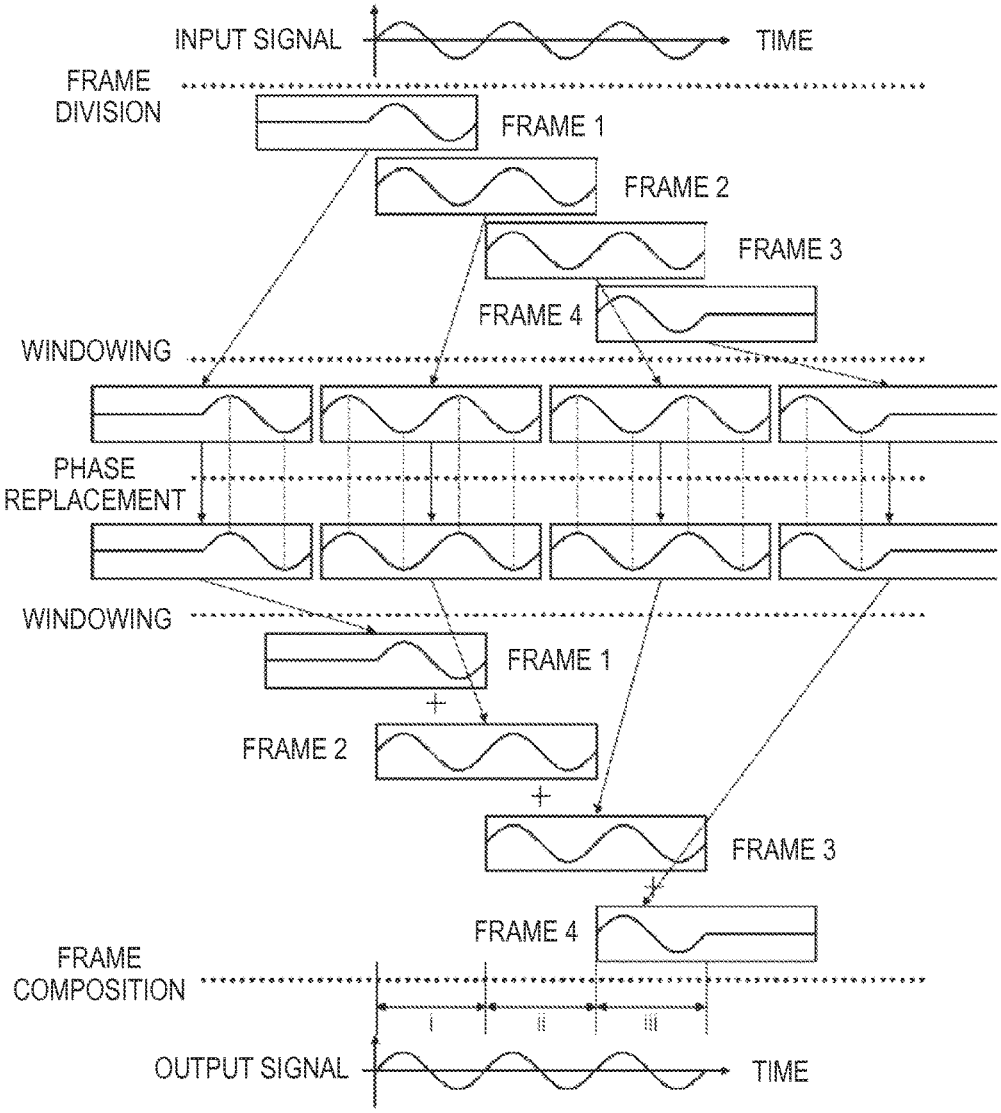
FIG. 6 is a view for explaining the operation of the phase controller according to the second embodiment of the present invention.
Figure 7:
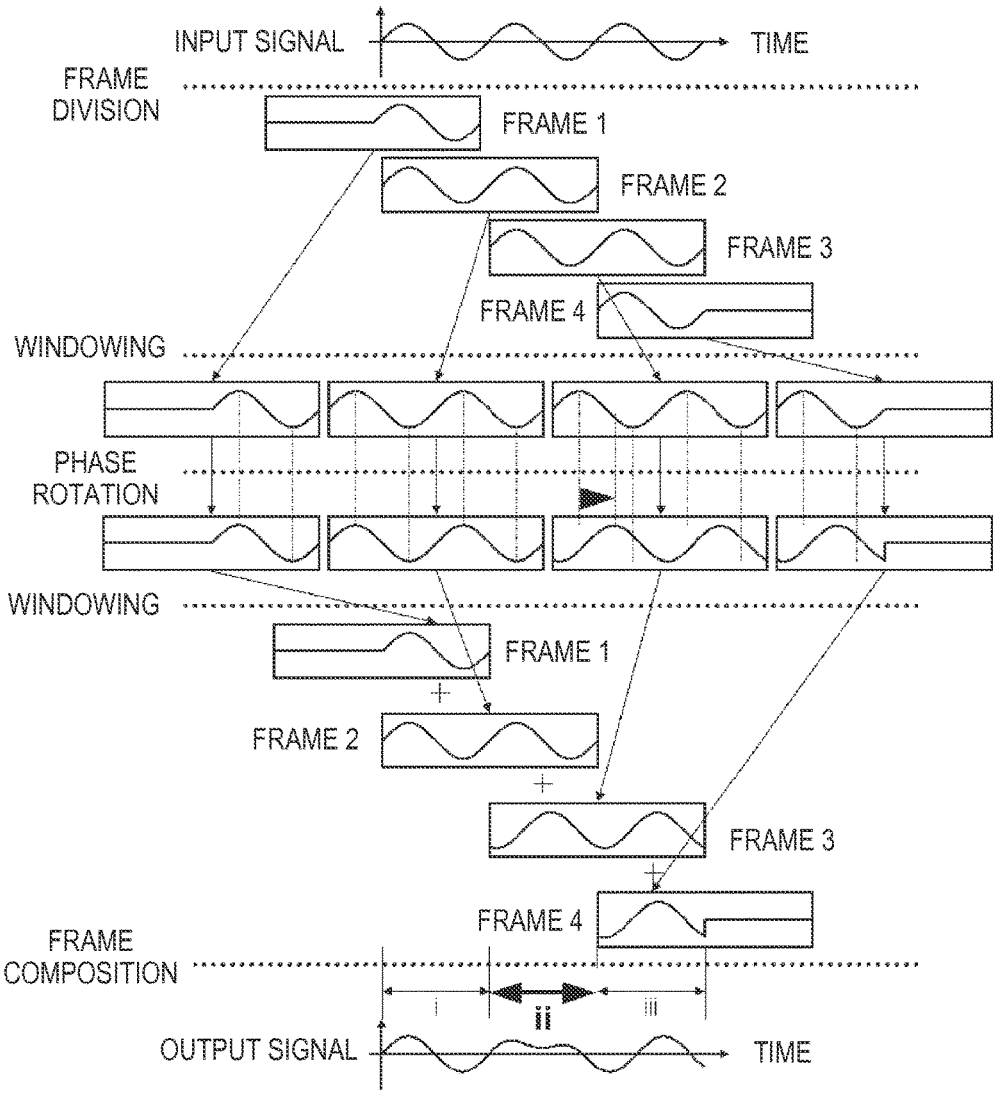
FIG. 7 is a view for explaining the operation of the phase controller according to the second embodiment of the present invention.

A correction coefficient calculation method by the correction amount calculator 503 will be described. First, a decrease in the output level caused by phase rotation will be described first with reference to FIGS. 6 and 7. FIGS. 6 and 7 show signals obtained by processing a noisy signal by the block diagram shown in FIG. 2. The difference between FIGS. 6 and 7 is the presence/absence of phase rotation. FIG. 6 shows a signal in a case where phase rotation is not performed, and FIG. 7 shows a signal in a case where phase rotation is performed from frame 3.

A signal in a case where phase rotation is not performed will be described with reference to FIG. 6. A noisy signal is illustrated in the uppermost portion of FIG. 6. The noisy signal is divided into frames by the frame divider 301. The second signal from above is the signal after frame division. A signal corresponding to four successive frames is illustrated here. The frame overlap ratio is 50%.

The signal divided into frames is windowed by the windowing unit 302. The third signal from above, which is separated by a dotted line, is the signal after windowing. In FIG. 6, to clarify the influence of phase rotation, weighting using a rectangular window is performed.

Next, the Fourier transformer 303 transforms the signal into a signal in a frequency domain. The signal in the frequency domain is not illustrated in FIG. 6. A signal transformed into a time domain by the inverse Fourier transformer 401 of the inverter 204 is shown in the portion under the dotted line of phase rotation. The fourth signal from above, which is separated by a dotted line, is the signal after phase rotation. In FIG. 6, however, the signal does not change from that after windowing because phase rotation is not performed.

An enhanced signal output from the inverse Fourier transformer 401 of the inverter 204 undergoes windowing again. FIG. 6 shows a case where weighting using a rectangular window is performed. The windowed signals are composited by the frame composition unit 403. At this time, times between the frames need to match. Since the overlap ratio is 50%, the frames overlap just in half. If phase rotation is not executed, the input signal and the output signal match, as shown in FIG. 6.

A signal in a case where phase rotation is performed will be described with reference to FIG. 7. FIG. 7 shows a signal in a case where phase rotation is performed from frame 3. The same noisy signal as in FIG. 6 is illustrated in the uppermost portion. The signal after frame division and the signal after windowing are also the same as in FIG. 6.

FIG. 7 illustrates a case where predetermined phase rotation is executed from frame 3. Place focus on the section of a right triangle shown in the portion under the dotted line of phase rotation processing. By phase rotation processing, the signals of frames 3 and 4 shift in the time direction. The signal that has undergone the phase rotation is windowed again, and the frames are composited. At this time, a difference is generated between the signal of frames 2 and that of frame 3 in a section ii where frames 2 and 3 overlap. This makes the output signal level after frame composition small in the section ii. That is, when phase rotation is executed, the output signal level lowers in the section ii in FIG. 7.

Lowering of the output signal level caused by phase rotation can also be explained in vector composition in a frequency domain by replacing addition in the time domain with addition in the frequency domain.

Figure 8:
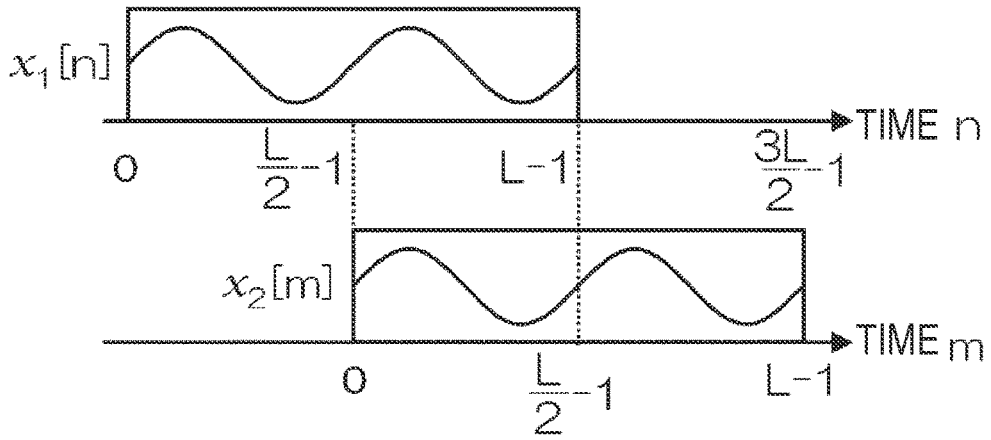
FIG. 8 is a view for explaining the operation of the phase controller according to the second embodiment of the present invention.

FIG. 8 shows the noisy signals of two successive frames after frame division and windowing as x1[$n$] and x2[$m$]. Note that the overlap ratio is 50%. Here, n indicates the discrete time of x1, and m indicates the discrete time of x2. When the overlap ratio is 50%, $$m=n+L/2 \tag{10}$$

holds.

In addition, the relationship between x1 and x2 is represented by $$x_2[m]=x_1[n+L/2] \tag{11}$$

The formula of transform from a time domain signal to a frequency domain signal and that of inverse transform will be described. By Fourier transform of a time domain signal x[n], a frequency domain signal X[k] is expressed as $$X[k]=\sum_{n=0}^{L-1} x[n]e^{-j2\pi\frac{n}{L}k} \tag{12}$$

where k is the discrete frequency, and L is the frame length.

When the frequency domain signal X[n] is returned to the time domain signal x[n] by inverse transform, the time domain signal x[n] is expressed as $$x[n]=\frac{1}{L}\sum_{k=0}^{L-1} X[k]e^{j2\pi\frac{n}{L}k} \tag{13}$$

When the time domain signals x1[$n$] and x2[$m$] are transformed into frequency domain signals X1[$k$] and X2[$k$] based on this equation, they are expressed as $$X_1[k]=\sum_{n=0}^{L-1} x_1[n]e^{-j2\pi\frac{n}{L}k} \tag{14}$$

-continued $$X_2[k] = \sum_{m=0}^{L-1} x_2[m]e^{-j2\pi\frac{m}{L}k} \tag{15}$$

When the frequency domain signals X1[$k$] and X2[$k$] are returned to the time domain signals x1[$n$] and x2[$m$] by inverse transform, respectively, they are expressed, based on equation (13), as $$x_1[n] = \frac{1}{L}\sum_{k=0}^{L-1} X_1[k]e^{j2\pi\frac{n}{L}k} \tag{16}$$

$$x_2[m] = \frac{1}{L}\sum_{k=0}^{L-1} X_2[k]e^{j2\pi\frac{m}{L}k} \tag{17}$$

The inverter transforms each frequency domain signal into a time domain signal by Fourier transform. After that, the frame composition unit adds the enhanced speech of the preceding frame and that of the current frame which overlap. For example, when the overlap ratio is 50% as in the illustrated example, the adjacent frames are added in the section of the discrete time m=L/2 to L−1. Consider the addition section m=L/2 to L−1.

When equations (16) and (17) are substituted into time domain addition, the addition is expressed as $$x_1[n] + x_2[m] = \frac{1}{L}\sum_{k=0}^{L-1} X_1[k]e^{j2\pi\frac{n}{L}k} + \frac{1}{L}\sum_{k=0}^{L-1} X_2[k]e^{j2\pi\frac{m}{L}k} \tag{18}$$

When equations (14) and (15) are further substituted into the frequency domain signals X1[$k$] and X2[$k$] in equation (18), the addition is expressed as $$x_1[n] + x_2[m] = \frac{1}{L}\sum_{k=0}^{L-1} X_1[k]e^{j2\pi\frac{n}{L}k} + \frac{1}{L}\sum_{k=0}^{L-1} X_2[k]e^{j2\pi\frac{m}{L}k} = \frac{1}{L}\sum_{k=0}^{L-1}\left(\sum_{n=0}^{L-1} x_1[n]e^{-j2\pi\frac{n}{L}k}\right) + \frac{1}{L}\sum_{k=0}^{L-1}\left(\sum_{m=0}^{L-1} x_2[m]e^{-j2\pi\frac{m}{L}k}\right)e^{j2\pi\frac{m}{L}k} \tag{19}$$

When equations (19) is expanded, the addition is expressed as $$\begin{aligned} x_1[n] + x_2[m] &= \frac{1}{L}\sum_{k=0}^{L-1}\left(\sum_{n=0}^{L-1} x_1[n]e^{-j2\pi\frac{n}{L}k}\right)e^{j2\pi\frac{n}{L}k} + \frac{1}{L}\sum_{k=0}^{L-1}\left(\sum_{m=0}^{L-1} x_2[m]e^{-j2\pi\frac{m}{L}k}\right)e^{j2\pi\frac{m}{L}k} = \\ &\frac{1}{L}\sum_{k=0}^{L-1}\left(x_1[0]e^{-j2\pi\frac{0}{L}k} + x_1[1]e^{-j2\pi\frac{1}{L}k} + \ldots + x_1[L-1]e^{-j2\pi\frac{L-1}{L}k}\right) e^{j2\pi\frac{n}{L}k} + \frac{1}{L}\sum_{k=0}^{L-1}\left(x_2[0]e^{-j2\pi\frac{0}{L}k} + x_2[1]e^{-j2\pi\frac{1}{L}k} + \ldots + x_2[L-1]e^{-j2\pi\frac{L-1}{L}k}\right)e^{j2\pi\frac{m}{L}k} = \end{aligned} \tag{20}$$

-continued $$\frac{1}{L}\left\{x_1[0]\sum_{k=0}^{L-1} e^{j\frac{2\pi}{L}(n-0)k} + x_1[1]\sum_{k=0}^{L-1} e^{j\frac{2\pi}{L}(n-0)k} + \ldots + x_1[L-1]\sum_{k=0}^{L-1} e^{j\frac{2\pi}{L}(n-L-1)k}\right\} + \frac{1}{L}\left\{x_2[0]\sum_{k=0}^{L-1} e^{j\frac{2\pi}{L}(m-0)k} + x_2[1]\sum_{k=0}^{L-1} e^{j\frac{2\pi}{L}(m-1)k} + \ldots + x_2[L-1]\sum_{k=0}^{L-1} e^{j\frac{2\pi}{L}(m-L-1)k}\right\}$$

Consider the sum operation included in each term of equation (20). When an arbitrary integer g is introduced, $$\sum_{k=0}^{L-1} e^{j\frac{2\pi}{L}gk} \tag{21}$$

holds.

The inverse Fourier transformation of a delta function δ[g] is given by $$\delta[g] = \frac{1}{L}\sum_{k=0}^{L-1} e^{j\frac{2\pi}{L}gk} \tag{22}$$

The delta function δ[g] is represented by $$\delta[g] = \begin{cases} 1 & g = 0 \\ 0 & g \neq 0 \end{cases} \tag{23}$$

Based on equation (22), expression (21) can be rewritten as $$\sum_{k=0}^{L-1} e^{j\frac{2\pi}{L}gk} = L\cdot\delta[g] \tag{24}$$

From the relation of equation (24), equation (20) is represented by $$\begin{aligned} x_1[n] + x_2[m] &= \\ &\frac{1}{L}\{L\cdot x_1[0]\delta[0] + L\cdot x_1[1]\delta[n-1] + \ldots + L\cdot x_1[L-1]\delta[n-L+1]\} + \\ &\frac{1}{L}\{L\cdot x_2[0]\delta[0] + L\cdot x_2[1]\delta[m-1] + \ldots + L\cdot x_2[L-1]\delta[m-L+1]\} \end{aligned} \tag{25}$$

Hence, equation (20) changes to $$x_1[n] + x_2[m] = \frac{1}{L}\{L\cdot x_1[n]\} + \frac{1}{L}\{L\cdot x_2[m]\} = x_1[n] + x_2[m] \tag{26}$$

Figure 9:
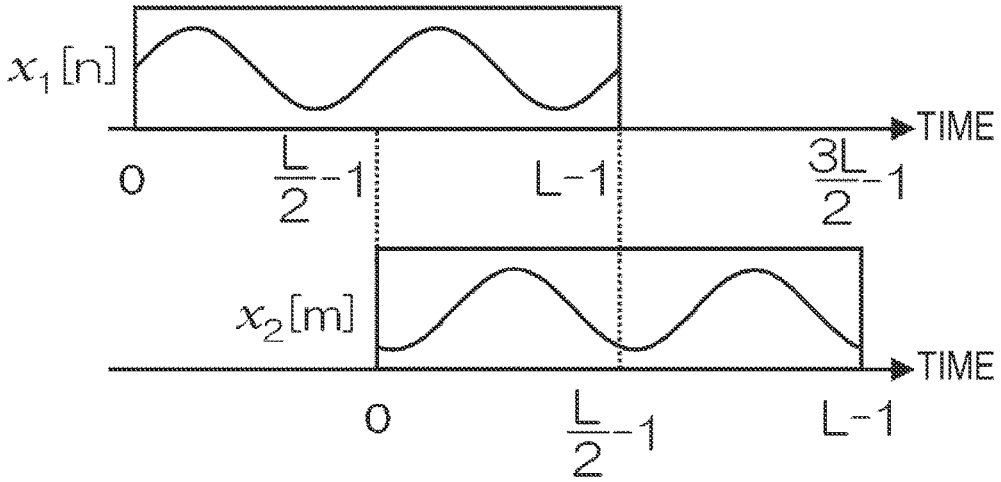
FIG. 9 is a view for explaining the operation of the phase controller according to the second embodiment of the present invention.

Consider a case where phase rotation is performed for the frequency domain signal X2[$k$]. At this time, a time domain signal as shown in FIG. 9 is obtained.

When the phase spectrum of X2[$k$] is rotated by φ[k], inverse transform is represented by $$x_2[m] = \frac{1}{L}\sum_{k=0}^{L-1} X_2[k]e^{j\phi[k]}e^{j2\pi\frac{m}{L}k} \tag{27}$$

When this is substituted into equation (18), $$x_1[n] + x_2[m] = \frac{1}{L}\sum_{k=0}^{L-1} X_1[k]e^{j2\pi\frac{n}{L}k} + \frac{1}{L}\sum_{k=0}^{L-1} X_2[k]e^{j\phi[k]}e^{j2\pi\frac{m}{L}k} = \frac{1}{L}\sum_{k=0}^{L-1}\left(\sum_{n=0}^{L-1} x_1[n]e^{-j2\pi\frac{n}{L}k}\right)e^{j2\pi\frac{n}{L}k} + \frac{1}{L}\sum_{k=0}^{L-1}\left(\sum_{m=0}^{L-1} x_2[m]e^{-(j2\pi\frac{m}{L}k+\phi[k])}\right)e^{j2\pi\frac{m}{L}k} \tag{28}$$

holds.

When this is expanded, $$x_1[n] + x_2[m] = \frac{1}{L}\left\{x_1[0]\sum_{k=0}^{L-1} e^{j\frac{2\pi}{L}(n-0)k} + x_1[1]\sum_{k=0}^{L-1} e^{j\frac{2\pi}{L}(n-1)k} + \ldots + x_1[L-1]\sum_{k=0}^{L-1} e^{j\frac{2\pi}{L}(n-L+1)k}\right\} + \frac{1}{L}\left\{x_2[0]\sum_{k=0}^{L-1} e^{j\frac{2\pi}{L}(m-0)k}e^{j\phi[k]} + x_2[1]\sum_{k=0}^{L-1} e^{j\frac{2\pi}{L}(m-1)k}e^{j\phi[k]} + \ldots + x_2[L-1]\sum_{k=0}^{L-1} e^{j\frac{2\pi}{L}(m-L+1)k}e^{j\phi[k]}\right\} \tag{29}$$

holds.

Assume that the overlap ratio is 50%, and consider n=L/2 to L−1 of the overlap section. In the overlap section, equation (11) can be expanded to $$x_1\left[n+\frac{L}{2}\right] + x_2[m] = \frac{1}{L}\left\{x_1\left[\frac{L}{2}\right]\sum_{k=0}^{L-1} e^{j\frac{2\pi}{L}(n+\frac{L}{2}-\frac{L}{2})k} + x_1\left[\frac{L}{2}+1\right]\sum_{k=0}^{L-1} e^{j\frac{2\pi}{L}(n+\frac{L}{2}-1-\frac{L}{2}-1)k} + \ldots + x_1[L-1]\sum_{k=0}^{L-1} e^{j\frac{2\pi}{L}(n-\frac{L}{2}-L+1-L+1)k}\right\} + \frac{1}{L}\left\{x_2[0]\sum_{k=0}^{L-1} e^{j\frac{2\pi}{L}(n-0)k}e^{j\phi[k]} + x_2[1]\sum_{k=0}^{L-1} e^{j\frac{2\pi}{L}(n-1)k}e^{j\phi[k]} + \ldots + x_2\left[L-\frac{L}{2}-1\right]\sum_{k=0}^{L-1} e^{j\frac{2\pi}{L}(n-\frac{L}{2}-L+1)k}e^{j\phi[k]}\right\} = \frac{1}{L}\left\{x_2[0]\sum_{k=0}^{L-1} e^{j\frac{2\pi}{L}nk} + x_2[1]\sum_{k=0}^{L-1} e^{j\frac{2\pi}{L}nk} + \ldots + x_2\left[L-\frac{L}{2}-1\right]\sum_{k=0}^{L-1} e^{j\frac{2\pi}{L}nk}\right\} + \tag{30}$$

-continued $$\frac{1}{L}\left\{x_2[0]\sum_{k=0}^{L-1} e^{j\frac{2\pi}{L}(n-0)k}e^{j\phi[k]} + x_2[1]\sum_{k=0}^{L-1} e^{j\frac{2\pi}{L}(n-1)k}e^{j\phi[k]} + \ldots + x_2\left[L-\frac{L}{2}-1\right]\sum_{k=0}^{L-1} e^{j\frac{2\pi}{L}(n-\frac{L}{2}-L+1)k}e^{j\phi[k]}\right\} = \frac{1}{L}\left\{x_2[0]\sum_{k=0}^{L-1} e^{j\frac{2\pi}{L}nk}(1+e^{j\phi[k]}) + x_2[1]\sum_{k=0}^{L-1} e^{j\frac{2\pi}{L}(n-1)k}(1+e^{j\phi[k]}) + \ldots + x_2\left[\frac{L}{2}-1\right]\sum_{k=0}^{L-1} e^{j\frac{2\pi}{L}(n-\frac{\pi}{2}-1)k}(1+e^{j\phi[k]})\right.$$

Figure 10:
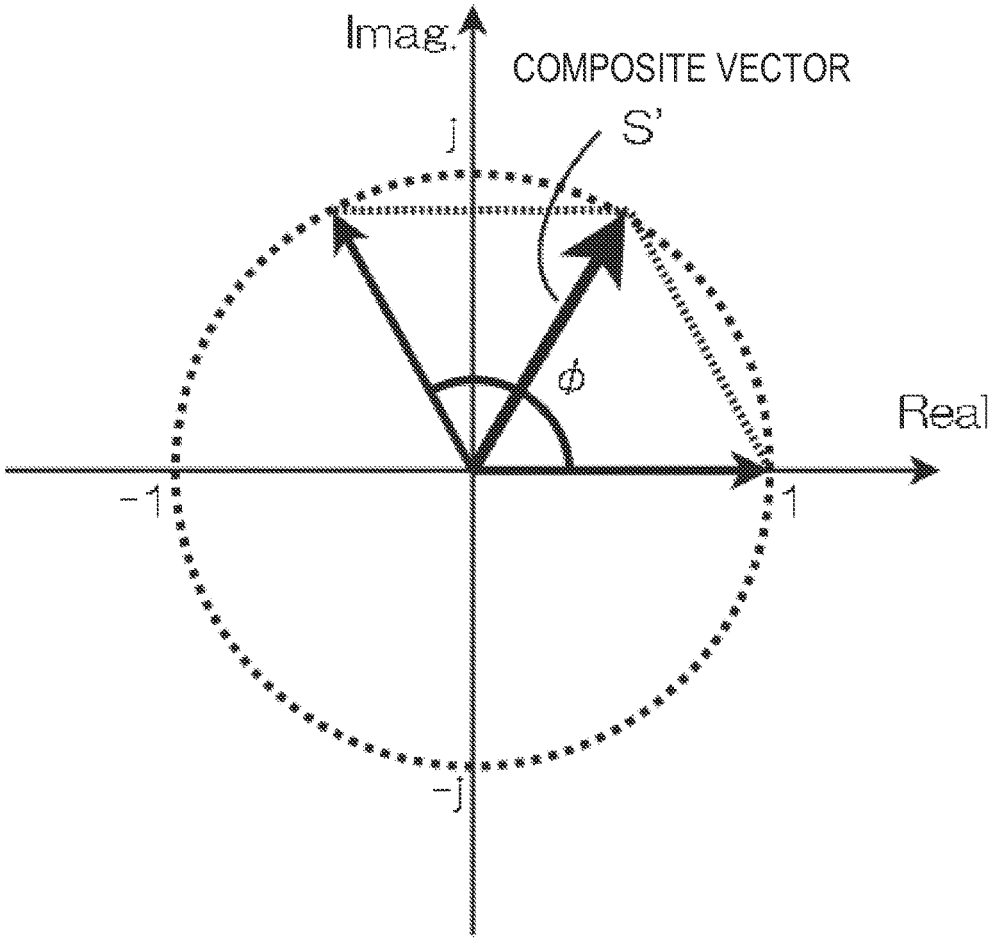
FIG. 10 is a view for explaining the operation of the phase controller according to the second embodiment of the present invention.
Figure 11:
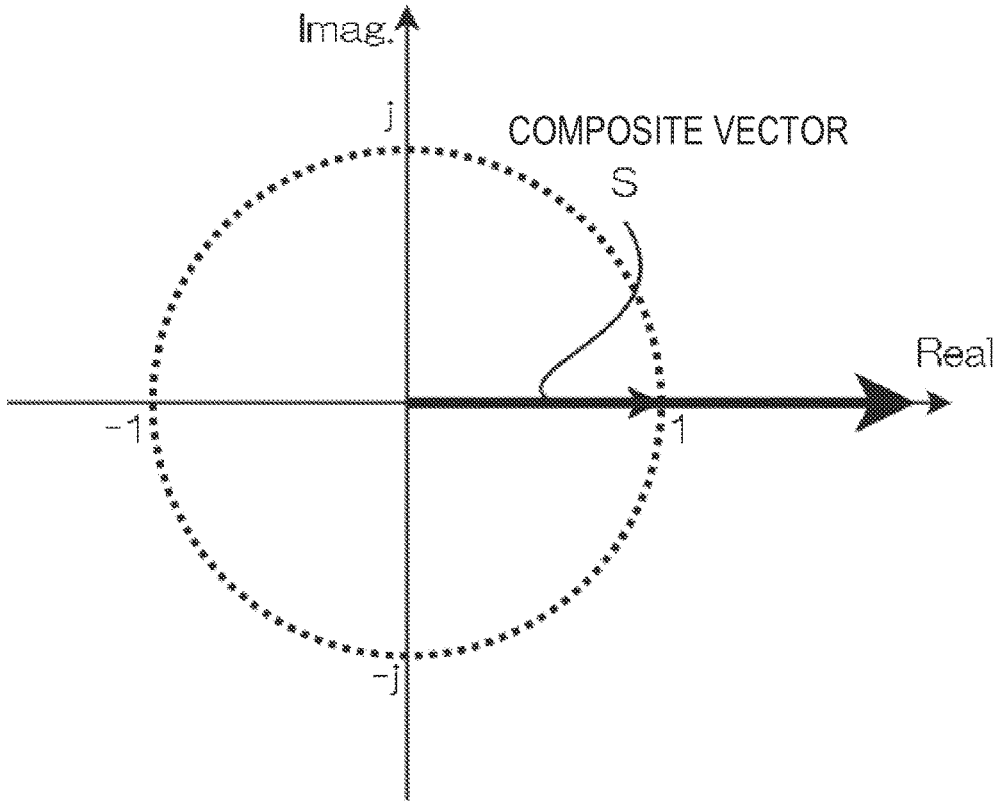
FIG. 11 is a view for explaining the operation of the phase controller according to the second embodiment of the present invention.

Here, $$1+e^{j\varphi[k]} \tag{31}$$

parenthesized in each term represents vector composition, and can be drawn as in FIG. 10 when placing focus on the specific frequency k. If phase rotation is not performed, that is, when φ[k]=0, it can be drawn as in FIG. 11.

The absolute value of equation (31) is obtained as $$|1+e^{j\phi[k]}| = |1+\cos\phi[k] + j\sin\phi[k]| = \sqrt{(1+\cos\phi[k])^2+\sin^2\phi[k]} = \sqrt{1+2\cos\phi[k]+\cos^2\phi[k]+\sin^2\phi[k]} = \sqrt{2(1+\cos\phi[k])} \tag{32}$$

Hence, the condition to maximize the absolute value of equation (31) is φ[k]=0, and the value is 2. That is, when phase rotation is performed, the magnitude of the output signal becomes small, as is apparent. The correction amount calculator 503 decides the amplitude correction amount of the enhanced signal amplitude spectrum so as to correct the decrease amount of the output signal level.

A method of calculating a correction amount will be described here in detail assuming that the phase rotation amount is decided by a uniform random number. To simplify the problem, focus is placed on the variation in the magnitude caused by phase rotation, and each frequency component is assumed to have been normalized to a unit vector.

A case where phase rotation is not performed will be considered first. The composite vector in a case where the phase does not change between successive frames is represented by S shown in FIG. 11. The magnitude of the vector, |S| is given by $$|S| = \sqrt{\{1+1\}^2} = \sqrt{2^2} = 2 \tag{33}$$

On the other hand, when phase rotation is performed by a uniform random number, the phase differences φ between successive frames are uniformly distributed within the range of −π to +π. The composite vector in a case where the phase changes between successive frames is represented by a vector S' shown in FIG. 10. The magnitude of the vector, |S'| is given by $$|S'| = \sqrt{\{1+\cos\phi\}^2+\{\sin\phi\}^2} = \sqrt{2+2\{\cos\phi\}} \tag{34}$$

An expected value E(|S'|^2) is obtained as $$E(|S'|^2)=E(2+2\cos\varphi)=E(2)+E(2\cos\varphi) \tag{35}$$

Since the differences φ are uniformly distributed from −π to +π, we obtain $$E(2\cos(\varphi))=0 \tag{36}$$

For this reason, the expected value E(|S'|^2) is given by $$E(|S'|^2)=2 \tag{37}$$

Based on equation (33), the expected value E(|S'|^2) in a case where phase rotation is not performed is given by $$\begin{aligned} E(|S|^2) &= E(2^2) \\ &= E(4) \\ &= 4 \end{aligned} \tag{38}$$

When the ratio of equation (37) to equation (38) is calculated, $$\begin{aligned} E(|S'|^2)/E(|S|^2) &= 2/4 \\ &= 1/2 \end{aligned} \tag{39}$$

holds.

That is, when the phase is rotated by a uniform random number, the power average value of the output signal decreases to ½ as compared to the input. The amplitude corrector 504 performs correction of the amplitude value. Hence, the correction amount calculator 503 obtains sqrt(2) as the correction coefficient and transmits it to the amplitude corrector 504.

Rotation amount generation by a uniform random number has been exampled above. The correction coefficient can also uniquely be obtained using a normal random number if its variance and average value are determined. Correction coefficient derivation using a normal random number will be described below.

When a normal random number is used, the occurrence probability of φ is decided by a normal distribution. Hence, to obtain a power expected value in a case where phase rotation is executed using a normal random number, weighting needs to be performed based on the occurrence probability of φ.

More specifically, a weight function f(φ) based on the occurrence probability of φ is introduced. By the weight function f(φ), cos(φ) is weighted. The weighted value is further normalized by the integrated value of the weight function f(φ), thereby obtaining the power expected value.

By introducing the weight function f(φ) and its integrated vale into equation (35) representing the output power expected value for a uniform random number, an output power expected value E(S"^2) in a case where phase rotation is performed using an normal random number can be expressed as $$E(|S''^2|)=E(2)+E\left(\frac{f(\phi)}{\int_{-\pi}^{\pi} f(\phi)\,d\phi}\cos(\phi)\right) \tag{40}$$

Since the weight function f(φ) can be expressed as a normal distribution, $$f(\phi)=\frac{1}{\sqrt{2\pi}\,\sigma}\exp\left(-\frac{(\phi-\mu)^2}{2\sigma^2}\right) \tag{41}$$

holds, where σ is the variance, and μ is the average value.

For example, in a standard normal distribution in which the average value μ=0, and the variance σ=1, $$f(\phi)=\frac{1}{\sqrt{2\pi}}\exp\left(-\frac{\phi^2}{2}\right) \tag{42}$$

holds. When this is substituted into equation (40), we obtain $$E(|S''^2|)=E(2)+E\left(\frac{\exp\left(-\frac{\phi^2}{2}\right)}{\int_{-\pi}^{\pi}\exp\left(-\frac{\phi^2}{2}\right)d\phi}\cos(\phi)\right) \tag{43}$$

By numerical calculation of the second term of the right-hand side of equation (43), $$E(|S''|^2)=2\{1+0.609\}=3.218 \tag{44}$$

holds. Hence, the ratio to E(|S^2|) in a case where phase rotation is not performed is given by $$E(|S''|^2)/E(|S|^2)=3.218/4=0.805 \tag{45}$$

In a case where the phase is rotated by a normal random number of a standard normal distribution, the correction amount calculator 503 obtains sqrt(1/0.805) as the correction coefficient and transmits it to the amplitude corrector 504. Amplitude correction is performed for a frequency that has undergone the phase rotation. Hence, the correction coefficient of a frequency that has not undergone the phase rotation is set to 1.0. Only the correction coefficient of the frequency that has undergone the phase rotation uses the value derived above.

As described above, in the amplitude controller 203, the amplitude correction coefficient is calculated using the phase rotation amount transmitted from the phase controller 202. The enhanced signal amplitude spectrum supplied from the noise suppressor 205 is multiplied by the correction coefficient and supplied to the inverter 204. This can eliminate lowering of the output level when the enhanced signal phase spectrum is obtained by rotating the noisy signal phase spectrum.

<<Arrangement of Linearity Calculator and Abrupt Change Determiner>>

Figure 12:
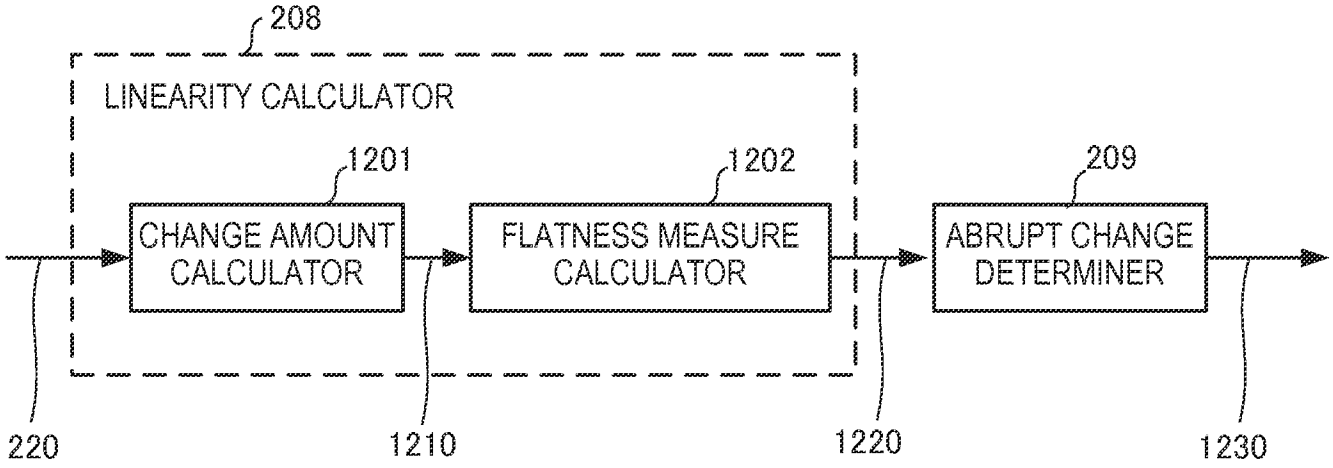
FIG. 12 is a block diagram for explaining the arrangement of a linearity calculator and an abrupt change determiner according to the second embodiment of the present invention.

FIG. 12 is a block diagram for explaining the internal arrangement of the linearity calculator 208 and the abrupt change determiner 209. As shown in FIG. 12, the linearity calculator 208 includes a change amount calculator 1201 that calculates a phase change amount in the frequency direction, and a flatness measure calculator 1202 that calculates the flatness measure of the phase change amount. The change amount calculator 1201 receives the phase component 220 (p(k) (k is a frequency)), and obtains a phase difference Δp(k)=p(k)−p(k−1) to an adjacent frequency as a phase change amount 1210 (phase gradient).

The flatness measure calculator 1202 checks the flatness measure (variation) of the phase change amount Δp(k)=p(k)−p(k−1) obtained by the change amount calculator 1201 along the frequency axis. A difference $\Delta_2 p(k)=\Delta p(k)-\Delta p(k-$ 1) of the phase change amount of the adjacent frequency is obtained as a flatness measure 1220. If the phase change amount is flat, the difference is 0. The differential value of the phase may be obtained as the phase change amount, and the differential value of the phase change amount may be obtained as the flatness measure 1220. In this case, if the quadratic differential value of the phase is close to 0 (equal to or smaller than a predetermined value), the phase change amount can be determined as flat.

The change amount calculator 1201 calculates the change amount using the phase difference between adjacent frequencies. However, the present invention is not limited to this. The linearity may be determined by differentiation of the frequency of the phase. The smaller the variation between a plurality of differential results of a plurality of frequencies is, the higher the linearity is. A local linearity can be determined using a local differential result. The flatness measure can be used as the index of the variation.

If the absolute value of the calculated flatness measure is equal to or smaller than a predetermined value, the abrupt change determiner 209 determines that the frequency corresponding to the flatness measure includes an impulsive sound. The abrupt change determiner 209 also compares the number of frequencies determined to include an impulsive sound with a predetermined threshold, and outputs impulsive sound present (1) or impulsive sound absent (0) as a determination result 1230 of the current frame.

Figure 13:
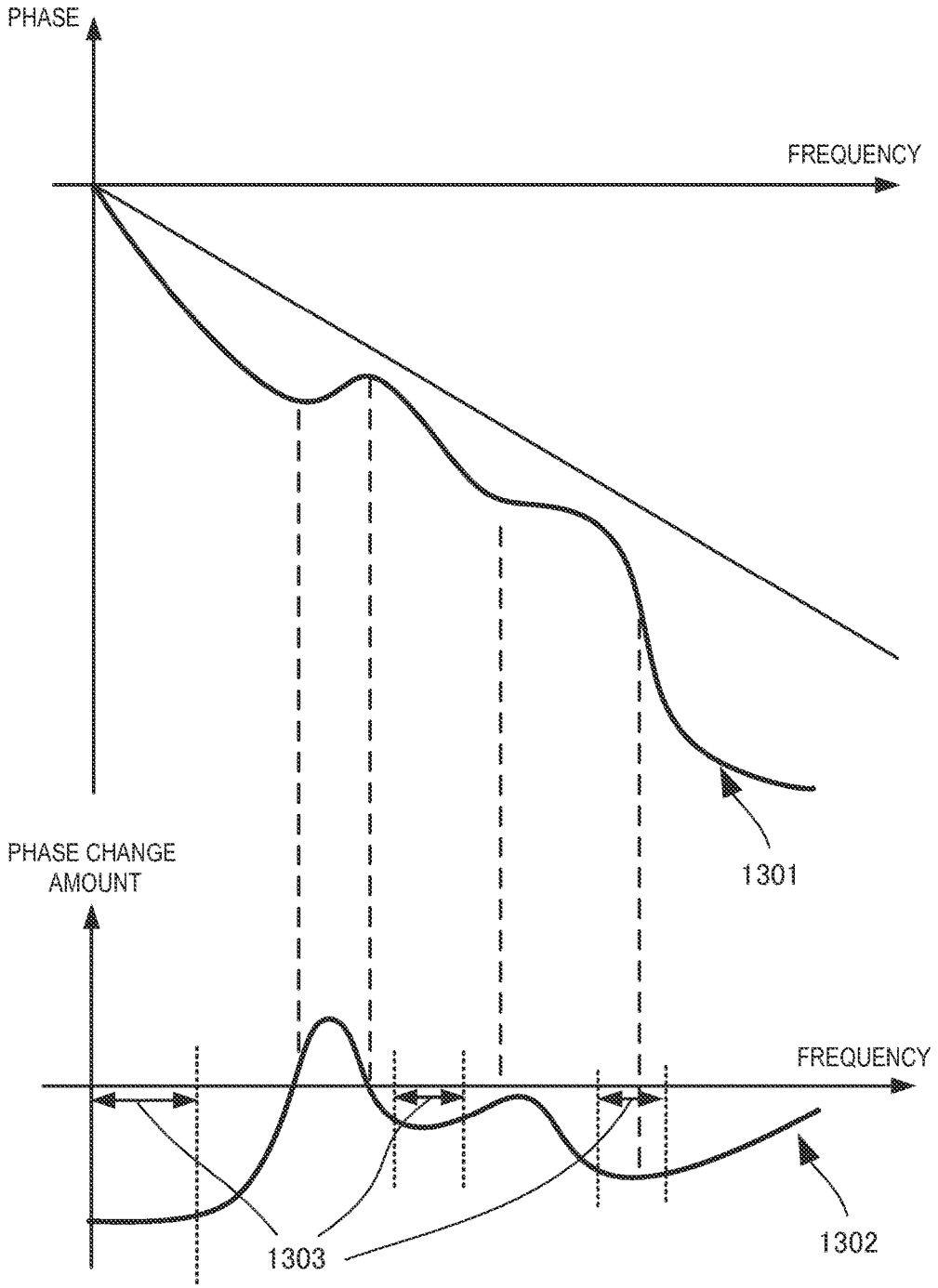
FIG. 13 is a graph for explaining processing of the linearity calculator according to the second embodiment of the present invention.

FIG. 13 is a graph showing a phase and its change amount. When the phase changes along the frequency axis in the frequency domain, like a graph 1301, the phase change amount changes as indicated by a graph 1302 along the frequency axis in the frequency domain. The linearity of the phase is discriminated by deriving a frequency 1303 at which the change is flat.

The phase is known to linearly change at a portion where the signal abruptly changes. It is therefore possible to determine the presence of an abrupt change in the signal by obtaining the linearity of the phase and determining the flatness measure in the above-described way. In a frame in which an abrupt signal change such as an impulsive sound exists, the abrupt change can be removed by rotating the phase spectrum. Hence, a high-quality enhanced signal can be obtained.

Figure 14:
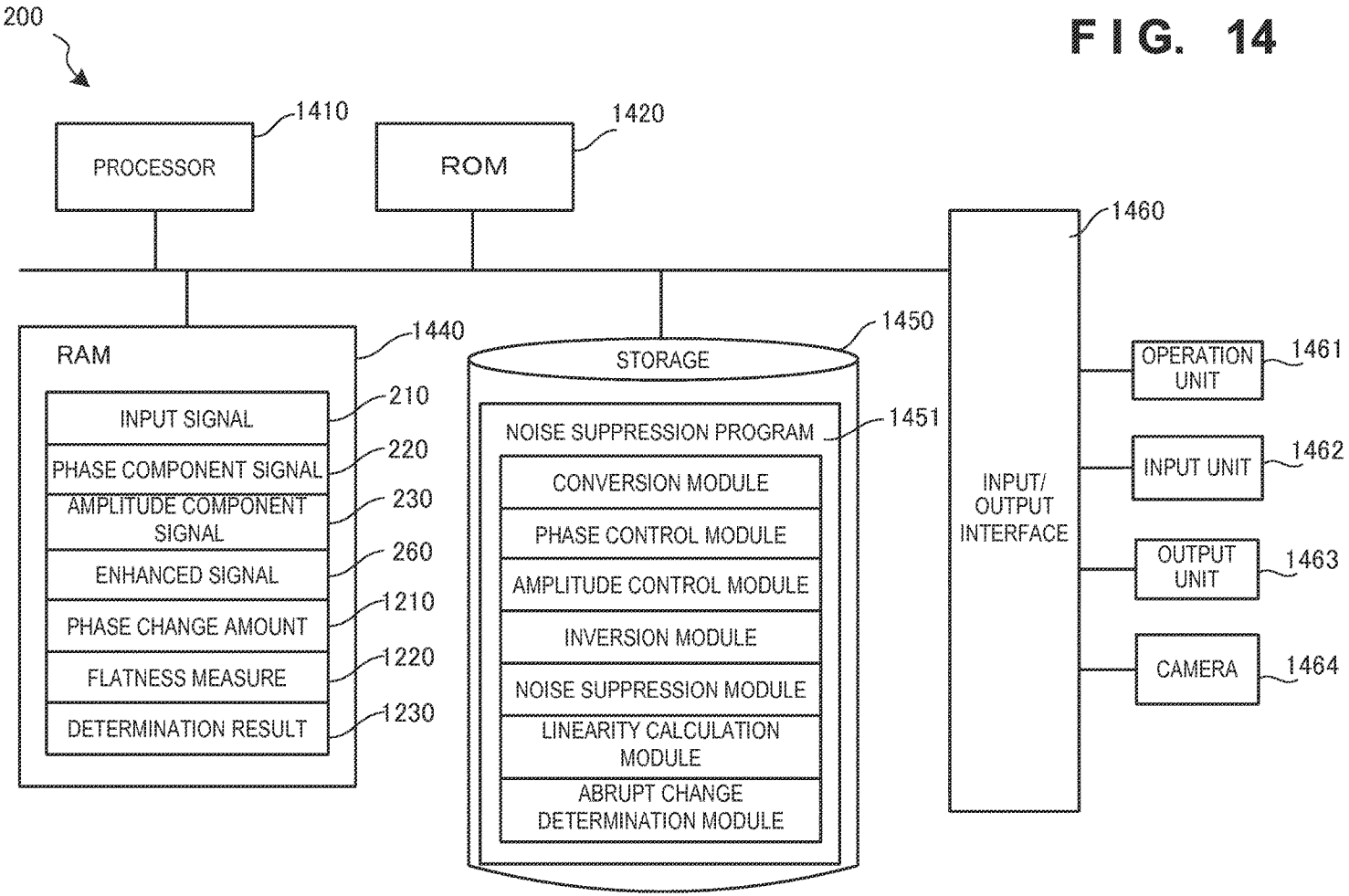
FIG. 14 is a block diagram showing the hardware arrangement of the noise suppression apparatus according to the second embodiment of the present invention.

FIG. 14 is a block diagram for explaining a hardware arrangement when the noise suppression apparatus 200 according to this embodiment is implemented using software.

The noise suppression apparatus 200 includes a processor 1410, a ROM (Read Only Memory) 1420, a RAM (Random Access Memory) 1440, a storage 1450, an input/output interface 1460, an operation unit 1461, an input unit 1462, and an output unit 1463. The noise suppression apparatus 200 may include a camera 1464. The processor 1410 is a central processing unit and executes various programs, thereby controlling the overall noise suppression apparatus 200.

The ROM 1420 stores various parameters as well as a boot program to be executed first by the processor 1410. The RAM 1440 includes an area to store an input signal 210, the phase component 220, the amplitude component 230, the enhanced signal 260, the phase change amount 1210, the flatness measure 1220, the determination result 1230, and the like as well as a program load area (not shown). The storage 1450 stores a noise suppression program 1451. The noise suppression program 1451 includes a conversion module, a phase control module, an amplitude control module, an inversion module, a noise suppression module, a linearity calculation module, and an abrupt change determination module. When the processor 1410 executes the modules included in the noise suppression program 1451, the functions of the converter 201, the phase controller 202, the amplitude controller 203, the inverter 204, the noise suppressor 205, the linearity calculator 208, and the abrupt change determiner 209 shown in FIG. 2 can be implemented. Note that the storage 1450 may store a noise database.

Enhanced speech that is the output of the noise suppression program 1451 executed by the processor 1410 is output from the output unit 1463 via the input/output interface 1460. This can suppress, for example, the operation sound of the operation unit 1461 input from the input unit 1462. Also possible is an application method of, for example, detecting impulsive sound inclusion in the input signal input from the input unit 1462 and starting shooting by the camera 1464.

Figure 15:
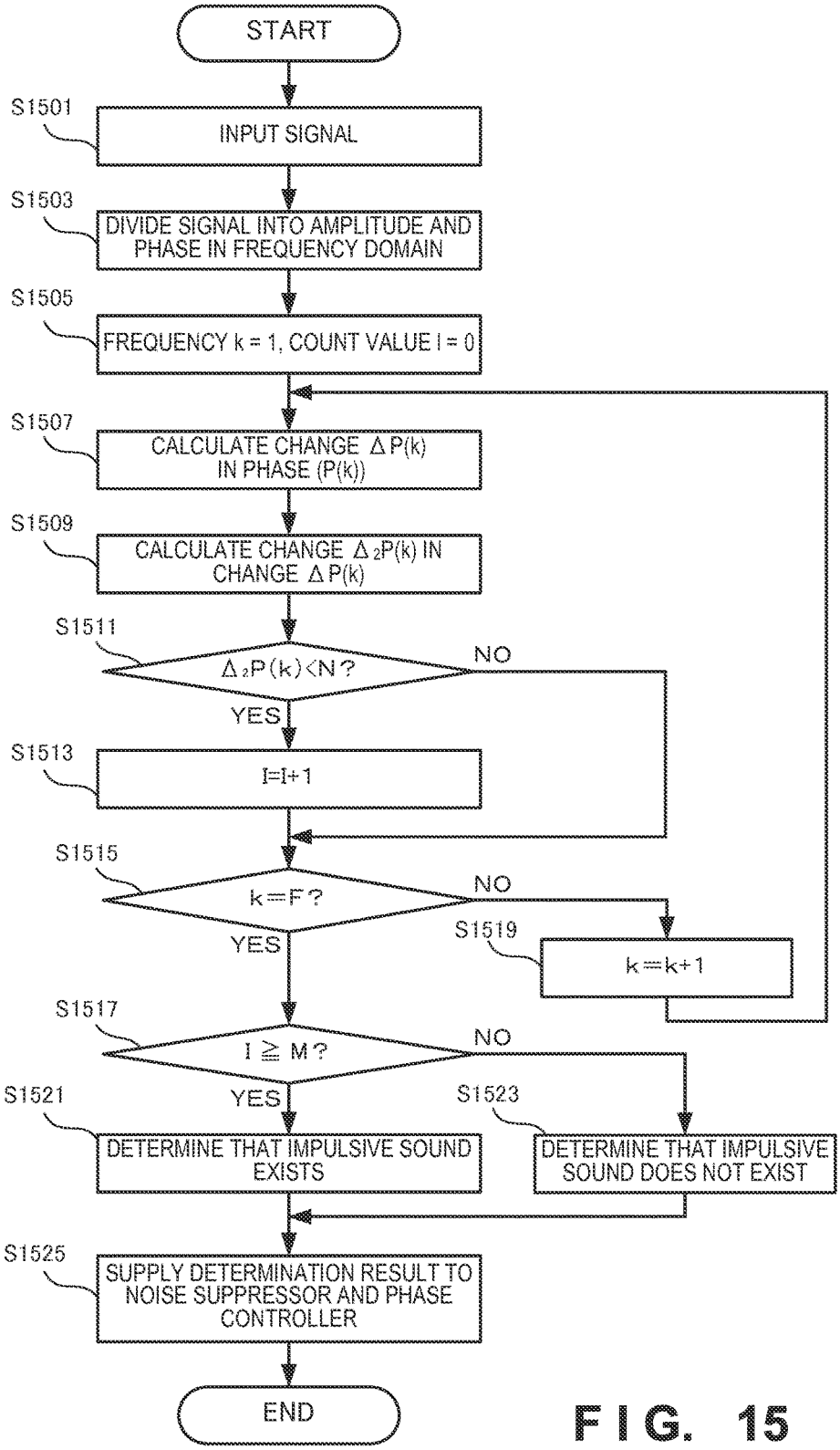
FIG. 15 is a flowchart for explaining the procedure of processing of the noise suppression apparatus according to the second embodiment of the present invention.

FIG. 15 is a flowchart for explaining the procedure of processing of the noise suppression program 1451. When a signal is input from the input unit 1462 in step S1501, the process advances to step S1503. In step S1503, the converter 201 converts the input signal into a frequency domain and divides it into an amplitude and a phase. In step S1505, the discrete frequency k is set to 1, the count value I is set to 0, and processing in the frequency space is sequentially started. When the process advances to step S1507, a change in the phase at the set frequency is calculated. In step S1509, a change in the phase change is calculated. The linearity of the phase is determined based on whether the change in the phase change falls within a predetermined range. More specifically, if the change in the phase change does not exceed a predetermined threshold N, it is determined that the phase changes flat, and the linearity is high, and I is incremented by one in step S1513. On the other hand, if the change in the phase change is equal to or more than the predetermined threshold N, it is determined that the phase change is not flat, and the linearity is low. The process advances to step S1515 without incrementing I. Steps S1507 to S1513 are repeated until k=F (F is the number of frequencies in the entire frame). Finally in step S1517, I (frequency with a high linearity) is compared with a predetermined threshold M. If I≥M, it is determined that an impulsive sound exists (step S1521). Otherwise, it is determined that no impulsive sound exists (step S1523). The determination result is supplied to the noise suppressor 205 and the phase controller 202 (step S1525).

With the above-described processing, an impulsive sound can more correctly be detected, and the impulsive sound can appropriately be removed as needed.

Other Embodiments

While the present invention has been described with reference to exemplary embodiments, it is to be understood that the invention is not limited to the disclosed exemplary embodiments. The arrangement and details of the present invention can variously be modified without departing from the spirit and scope thereof, as will be understood by those skilled in the art. The present invention also incorporates a system or apparatus that combines different features included in the embodiments in any form.

The present invention is applicable to a system including a plurality of devices or a single apparatus. The present invention is also applicable even when a signal processing program for implementing the functions of the embodiments is supplied to the system or apparatus directly or from a remote site. Hence, the present invention also incorporates the program installed in a computer to implement the functions of the present invention by the computer, a medium storing the program, and a WWW (World Wide Web) server that causes a user to download the program.

Note that in the above embodiments, the characteristic arrangements of a signal processing apparatus, a signal processing method, and a signal processing program to be described below are shown (the arrangements are not limited to those to be described below).

(Supplementary Note 1)

There is provided a signal processing apparatus comprising:

a converter that converts an input signal into a phase component and an amplitude component in a frequency domain;

a linearity calculator that calculates a linearity of the phase component in the frequency domain; and a determiner that determines presence of an abrupt change in the input signal based on the linearity calculated by the linearity calculator.

(Supplementary Note 2)

There is provided the signal processing apparatus according to supplementary note 1, wherein the linearity calculator calculates the linearity based on whether a change in the phase component in the frequency domain falls within a predetermined range.

(Supplementary Note 3)

There is provided the signal processing apparatus according to supplementary note 1 or 2, wherein the linearity calculator calculates a flatness measure of a differential value of the phase component in the frequency domain, and if the flatness measure of the differential value is high, the determiner determines that the abrupt change in the input signal exists.

(Supplementary Note 4)

There is provided the signal processing apparatus according to supplementary note 1, 2, or 3, wherein the linearity calculator calculates, for each frequency, a phase component difference as a difference between phase components at a frequency and an adjacent frequency, and calculates the linearity based on a difference between the phase component differences.

(Supplementary Note 5)

There is provided the signal processing apparatus according to supplementary note 4, wherein the linearity calculator compares the difference between the phase component differences with a first threshold for each frequency, and counts, for each frame, the number of frequency components with a difference not greater than the first threshold as the linearity, and if the linearity is not less than a second threshold, the determiner determines that the abrupt change exists in the input signal.

(Supplementary Note 6)

There is provided a signal processing method comprising:

converting an input signal into a phase component and an amplitude component in a frequency domain;

calculating a linearity of the phase component in the frequency domain; and determining presence of an abrupt change in the input signal based on the calculated linearity.

(Supplementary Note 7)

There is provided the signal processing method according to supplementary note 6, wherein the linearity is calculated based on whether a change in the phase component in the frequency domain falls within a predetermined range.

(Supplementary Note 8)

There is provided the signal processing method according to supplementary note 6 or 7, wherein the linearity is calculated by calculating a flatness measure of a differential value of the phase component in the frequency domain, and if the flatness measure of the differential value is high, the abrupt change in the input signal is determined to exist.

(Supplementary Note 9)

There is provided the signal processing method according to supplementary note 6, 7, or 8, wherein the linearity is calculated based on a difference between phase component differences calculated for each frequency as a difference between the phase component and a phase component of an adjacent frequency.

(Supplementary Note 10)

There is provided the signal processing method according to supplementary note 9, wherein the linearity is calculated as a count value obtained by comparing the difference between the phase component differences with a first threshold for each frequency and counting, for each frame, the number of frequency components for which the difference is determined to be not more than the first threshold, and the abrupt change in the input signal is determined to exist if the count value is not less than a second threshold.

(Supplementary Note 11)

There is provided a signal processing program for causing a computer to execute steps comprising:

converting an input signal into a phase component and an amplitude component in a frequency domain;

calculating a linearity of the phase component in the frequency domain; and determining presence of an abrupt change in the input signal based on the calculated linearity.

(Supplementary Note 12)

There is provided the signal processing program according to supplementary note 11, wherein the linearity is calculated based on whether a change in the phase component in the frequency domain falls within a predetermined range.

(Supplementary Note 13)

There is provided the signal processing program according to supplementary note 11 or 12, wherein the linearity is calculated by calculating a flatness measure of a differential value of the phase component in the frequency domain, and if the flatness measure of the differential value is high, the abrupt change in the input signal is determined to exist.

(Supplementary Note 14)

There is provided the signal processing program according to supplementary note 11, 12, or 13, wherein the linearity is calculated based on a difference between phase component differences calculated for each frequency as a difference between the phase component and a phase component of an adjacent frequency.

(Supplementary Note 15)

There is provided the signal processing program according to supplementary note 14, wherein the linearity is calculated as a count value obtained by comparing the difference between the phase component differences with a first threshold for each frequency and counting, for each frame, the number of frequency components for which the difference is determined to be not more than the first threshold, and the abrupt change in the input signal is determined to exist if the count value is not less than a second threshold.

This application claims the benefit of Japanese Patent Application No. 2013-042447, filed on Mar. 5, 2013, which is hereby incorporated by reference in its entirety.

The invention claimed is:

1. A signal processing apparatus comprising:

a converter that converts an input signal into a phase component and an amplitude component in a frequency domain;

a linearity calculator that calculates a linearity of the phase component at each frequency in the frequency domain; and a determiner that determines presence of an abrupt change in the input signal at each frequency based on the linearity calculated by said linearity calculator at each frequency.

2. The signal processing apparatus according to claim 1, wherein said linearity calculator calculates the linearity at each frequency based on whether a change in the phase component at each frequency in the frequency domain falls within a predetermined range.

3. The signal processing apparatus according to claim 1, wherein said linearity calculator calculates a flatness measure of a differential value of the phase component at each frequency in the frequency domain, and if the flatness measure of the differential value at each frequency is high, said determiner determines that the abrupt change in the input signal exists.

4. The signal processing apparatus according to claim 1, wherein said linearity calculator calculates, for each frequency, a phase component difference as a difference between phase components at a frequency and an adjacent frequency, and calculates the linearity based on a difference between the phase component differences at each frequency.

5. The signal processing apparatus according to claim 4, wherein said linearity calculator compares the difference between the phase component differences with a first threshold for each frequency, and counts, for each frame, the number of frequency components with a difference not greater than the first threshold as the linearity, and if the linearity is not less than a second threshold, said determiner determines that the abrupt change exists in the input signal.

6. A signal processing method comprising:

converting an input signal into a phase component and an amplitude component in a frequency domain;

calculating a linearity of the phase component at each frequency in the frequency domain; and determining presence of an abrupt change in the input signal at each frequency based on the calculated linearity at each frequency.

7. A non-transitory computer readable medium storing a signal processing program for causing a computer to execute steps comprising:

converting an input signal into a phase component and an amplitude component in a frequency domain;

calculating a linearity of the phase component at each frequency in the frequency domain; and determining presence of an abrupt change in the input signal at each frequency based on the calculated linearity at each frequency.

* * * * *